US006554382B1

(12) United States Patent
Sleger

(10) Patent No.: US 6,554,382 B1
(45) Date of Patent: Apr. 29, 2003

(54) INK CONTAINER ELECTRICAL RESISTANCE INK LEVEL SENSING MECHANISM AND METHOD FOR DETERMINING INK LEVEL INFORMATION

(75) Inventor: Roger R. Sleger, Eagle, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/100,646

(22) Filed: Mar. 19, 2002

(51) Int. Cl.[7] ..... B41J 2/195; B41J 29/393; B41J 2/175

(52) U.S. Cl. ..... 347/7; 347/19; 347/85

(58) Field of Search ..... 347/7, 3, 86, 85, 347/87, 19, 23, 14, 12, 10, 11, 84

(56) References Cited

U.S. PATENT DOCUMENTS

| | | | | |
|---|---|---|---|---|
| 4,551,734 A | | 11/1985 | Causley et al. | |
| 4,631,558 A | | 12/1986 | Hara | |
| 5,070,346 A | | 12/1991 | Mochizuki et al. | |
| 5,079,570 A | | 1/1992 | Mohr et al. | |
| 5,488,395 A | | 1/1996 | Takayanagi et al. | |
| 5,583,544 A | | 12/1996 | Stamer et al. | |
| 5,616,929 A | | 4/1997 | Hara | |
| 5,635,962 A | | 6/1997 | Goldis | |
| 5,652,610 A | | 7/1997 | Kawai et al. | |
| 5,682,184 A | | 10/1997 | Stephany et al. | |
| 5,844,580 A | | 12/1998 | Barinaga et al. | |
| 5,852,946 A | | 12/1998 | Cowger | |
| 5,900,888 A | | 5/1999 | Kurosawa | |
| 5,997,121 A | * | 12/1999 | Altfather et al. | 347/7 |

* cited by examiner

*Primary Examiner*—Craig Hallacher
*Assistant Examiner*—Charles W. Stewart, Jr.

(57) ABSTRACT

A replaceable ink container for providing ink to a printhead of a printing system. The ink container has a housing that includes and ink reservoir for containing a supply of ink, and an ink level sensor for sensing a low ink condition in the ink reservoir. The ink reservoir includes a capillary ink storage member. The ink level sensor includes resistance probes that are in fluid communication with the supply of ink, but are free from contact with the capillary ink storage member. The resistance probes are mounted to the housing by way of sensor ports that extend through the housing and prevent contact between the capillary ink storage member and the probes. The resistance probes protrude slightly from an exterior surface of the housing to define electrical contacts for engaging corresponding electrical contacts of the printing system. A change in electrical resistance measured across the resistance probes indicates a low ink condition in the ink reservoir.

14 Claims, 5 Drawing Sheets

INK CONTAINER ELECTRICAL RESISTANCE INK LEVEL SENSING MECHANISM AND METHOD FOR DETERMINING INK LEVEL INFORMATION

TECHNICAL FIELD

This invention relates generally to ink jet printing devices. In particular, the present invention is an inkjet cartridge including an ink level sensing mechanism having a pair of spaced electrical probes, wherein a change in electrical resistance measured between the electrical probes provides a reliable and accurate indication of a low ink condition in the ink reservoir of the ink container.

BACKGROUND OF THE INVENTION

Ink jet printing systems frequently make use of an ink jet printhead mounted within a carriage that is moved back and forth across print media, such as paper. As the printhead is moved across the print media, a control system activates the printhead to deposit or eject ink droplets onto the print media to form images and text. Ink is provided to the printhead by a supply of ink that is either carried by the carriage or mounted to the printing system such that the supply of ink does not move with the carriage. For the case where the ink supply is not carried with the carriage, the ink supply can be in fluid communication with the printhead to replenish the printhead or the printhead can be intermittently connected with the ink supply by positioning the printhead proximate to a filling station to which the ink supply is connected whereupon the printhead is replenished with ink from the refilling station.

For the case where the ink supply is carried with the carriage, the ink supply may be integral with the printhead whereupon the entire printhead and ink supply is replaced when ink is exhausted. Alternatively, the ink supply can be carried with the carriage and be separately replaceable from the printhead or drop ejection portion.

Regardless of where the supply of ink is located within the printing system, it is critical that the printhead be prevented from operating when the supply of ink is exhausted. Operation of the printhead once the supply of ink is exhausted results in poor print quality, printhead reliability problems, and, if operated for a sufficiently long time without a supply of ink, can cause catastrophic failure of the printhead. This catastrophic failure results in permanent damage to the printhead. In addition to preserving the functional integrity of the printing system, many applications, and sometimes users, need to know in advance if the ink supply is getting low. Typically, unattended printing applications, as in kiosks, have such needs. Attended business applications also commonly need to know if the ink supply is getting low, such that the ink supply, or ink cartridge, can be replenished before it actually runs out of ink. Therefore, it is important that the printing system be capable of reliably identifying a condition in which the ink supply is nearly or completely exhausted. In addition, the identification of the condition of a nearly or completely exhausted ink supply should be accurate, reliable, and relatively low cost, thereby tending to reduce the cost of the ink supply and the printing system.

One type of ink container including a capillary reservoir with an ink level sensor is disclosed in the U.S. Pat. No. 5,079,570 to Mohr et al. entitled "Capillary Reservoir Binary Ink Level Sensor" which is assigned to the same assignee as the instant application and which is incorporated herein in its entirety by reference thereto. Mohr et al. is directed to an ink container that includes a housing within which is provided a capillary reservoir for storing a quantity of ink. The capillary reservoir has stippling where there is ink and no stippling where there is no ink. On one end of the ink container housing is an ink outlet. An ink level sensor is provided on one surface of the ink container housing. The ink level sensor comprises a C-shaped, transparent, ink level sensing tube with a first or upper port a first distance above the ink outlet and a second or lower port a shorter distance above the ink outlet. Both the upper and lower ports are ported through the ink container housing to the capillary reservoir.

In operation, as long as the ink level is above the upper port, the C-shaped tube of the ink level sensor is full of ink and is in static equilibrium. However, when the ink level reaches the upper port, the ink is sucked from the C-shaped tube of the ink level sensor and into the capillary reservoir due to an imbalance in the capillary pressures at the ink/air interfaces between the capillary reservoir and the upper port. The resulting sudden (i.e., instantaneous) depletion of ink in the C-shaped tube of the ink level sensor provides an almost instantaneous binary fluid level indicator. Since the C-shaped tube of the ink level sensor is transparent, a light detecting sensing device positioned adjacent to the C-shaped tube, can detect when the tube is empty (i.e., detect the binary fluid level indicator), whereupon the printing system can notify a user of the low ink condition of the ink reservoir of the ink container.

Although the above described binary ink level sensor provides a reliable and accurate indication of a low ink level within the ink reservoir of the ink container, there are some drawbacks to this ink level sensing system. One drawback concerns the use of the transparent C-shaped tube. This C-shaped tube is somewhat fragile, and because this tube extends out away from the housing of the ink container, it is somewhat susceptible to inadvertent damage during handling of the ink container. Damage to this tube may affect the overall operation and accuracy of the ink level sensing system and may result in unwanted ink leakage from the ink container. Moreover, because the C-shaped tube extends out away from the housing of the ink container, it can become soiled during handling of the ink container by a user. If this soiling is severe it may adversely affect the ability of the light detecting sensing device to detect when the C-shaped tube has become depleted of ink, thereby adversely affecting the overall operation and ability of the ink level sensing system of the printer to detect and warn a user of a low ink condition within the ink container.

As such, there is a need for an ink container employing an ink level sensing mechanism that allows a printing system to reliably and accurately determine the ink level within an ink reservoir of the ink container. The ink level sensing mechanism of the ink container should provide an accurate indication of a low ink level within the ink container, and should not be easily soiled or susceptible to damage during routine handling by a user. Lastly, the ink container should be relatively easy and inexpensive to manufacture.

SUMMARY OF THE INVENTION

In an embodiment, the present invention is a replaceable ink container for providing ink to a printhead of a printing system. The ink container includes an ink reservoir for containing a supply of ink, and an ink level sensor for determining an amount of ink in the ink reservoir. The ink reservoir includes a capillary ink storage member. The ink level sensor includes first and second resistance probes in fluid communication with the supply of ink and free from contact with the capillary ink storage member. A change in electrical resistance measured across the first and second probes indicates the amount of ink in the ink reservoir.

BRIEF DESCRIPTION OF THE DRAWINGS

The accompanying drawings are included to provide a further understanding of the present invention and are incorporated in and constitute a part of this specification. The drawings illustrate the embodiments of the present invention and together with the description serve to explain the principals of the invention. Other embodiments of the present invention and many of the intended advantages of the present invention will be readily appreciated as the same become better understood by reference to the following detailed description when considered in connection with the accompanying drawings, in which like reference numerals designate like parts throughout the figures thereof, and wherein.

DETAILED DESCRIPTION OF THE PREFERRED EMBODIMENTS

Figure 1:
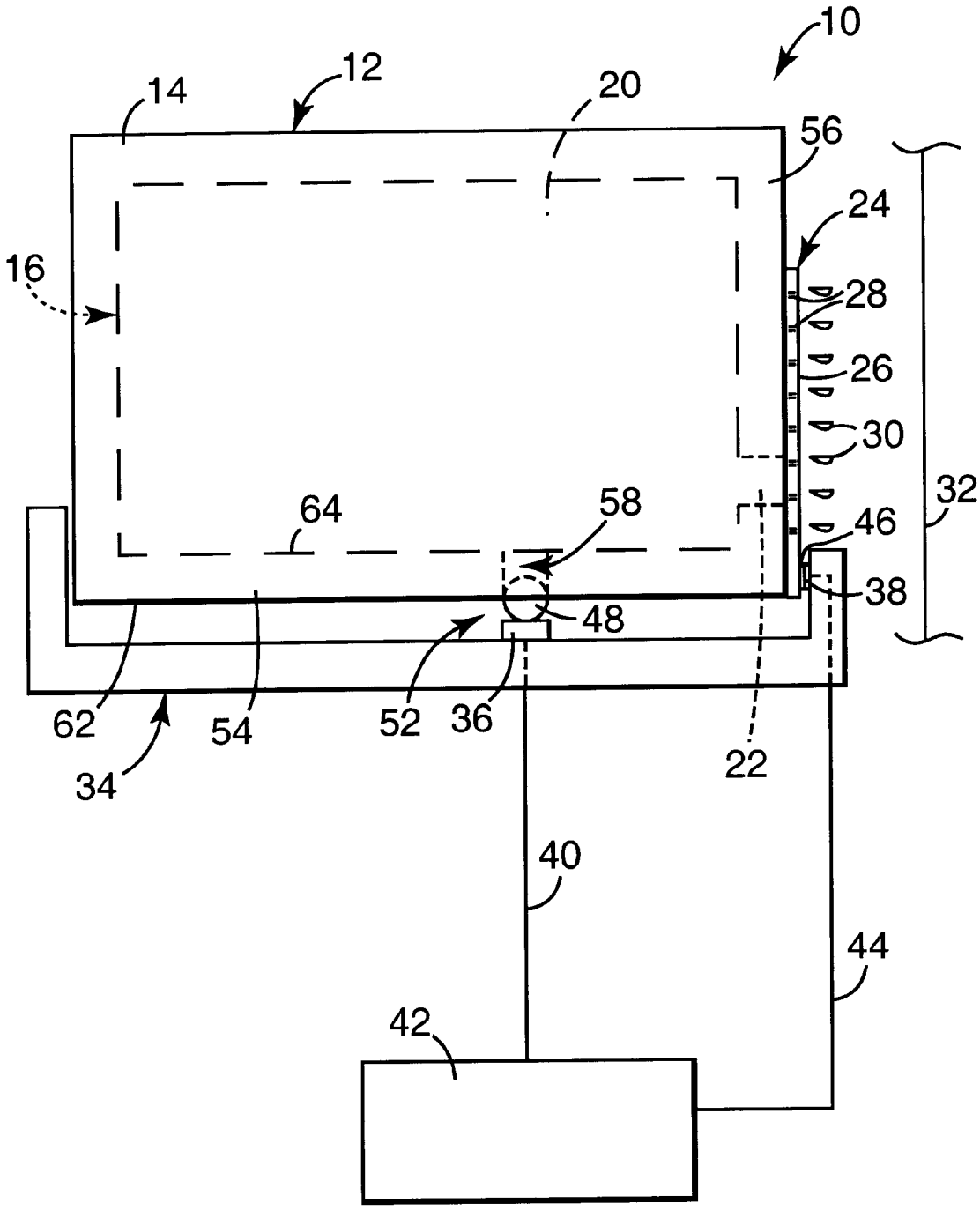
FIG. 1 is a schematic drawing of a printing system having a replaceable ink cartridge and an ink level sensing mechanism in accordance with an embodiment of the present invention.

FIG. 1 depicts a schematic representation of an inkjet printing system 10 which includes a replaceable inkjet container or cartridge (otherwise known as an inkjet pen) 12 in accordance with an embodiment of the present invention. As seen best in FIGS. 3–7, the ink cartridge 12 includes a housing 14 within which is an ink reservoir 16 for containing a supply of ink 18. The ink reservoir 16 is defined by a capillary ink storage member 20. In FIGS. 3–7, the ink reservoir 16 has dashed horizontal lines where there is ink and no dashed horizontal lines where there is no ink. On one end of the housing 14 is an ink outlet otherwise known as a fluid outlet 22 which is in fluid communication with the ink reservoir 16.

As seen best in FIG. 1, the fluid outlet 22 is in fluid communication with an inkjet printhead 24 for the printing system 10. The printhead 24 is defined by a nozzle plate 26 having a plurality of ink ejection nozzles 28. The ink reservoir 16 of the replaceable ink cartridge 12 provides ink 18 via the fluid outlet 22 to the ink ejection nozzles 28 of the nozzle plate 26 for ejection as ink drops 30 onto print media 32, such as paper.

Although, in one preferred embodiment illustrated in FIGS. 1–7, the ink reservoir 16 is shown integral with the printhead 24, such that the entire printhead 24 and ink reservoir 16 is replaced when ink is exhausted, alternatively, the ink reservoir 16 can be separately replaceable from the printhead 24. In the case of an "off-axis" printing system having a separately replaceable ink reservoir 16 and printhead 24, the fluid outlet 22 would generally be defined by a conduit that is typically flexible. In the case of an "on-axis" printing system, the fluid outlet 22 typically forms part of a releasable fluid interconnect for directly connecting the ink reservoir 16 to the printhead 24, or a releasable fluid interconnect for connecting the ink reservoir 16 to a portion of a manifold that receives the ink reservoir 16 and is in turn connected to the printhead 24 through the manifold.

As seen best in FIG. 1, the replaceable ink cartridge 12 is releasably insertable into a receiving station 34 of the inkjet printing system 10. The receiving station includes a first set of electrical contacts otherwise known as a pair of ink level sensor electrical contacts 36, and a second set of electrical contacts otherwise known as printhead electrical contacts 38. The pair ink level sensor electrical contacts 36 are linked by way of a first signal transmission line 40 to printer control electronics 42 of the printing system 10. The printhead electrical contacts 38 are linked by way of a second signal transmission line 44 to printer control electronics 42 of the printing system 10. When the ink cartridge 12 is inserted into the receiving station 34 the printhead electrical contacts 38 engage corresponding printhead electrical contacts 46 of the nozzle plate 26 of the ink cartridge 12. The printer control electronics 42 control various printing system 10 functions such as, but not limited to, printhead 24 activation to dispense ink and notification of a printing system 10 user of a low ink condition within the ink cartridge 12. In order to notify a user of a low ink condition and/or out of ink condition within the ink cartridge 12, the ink level sensor electrical contacts 36 of the receiving station 34 engage first and second, ink level sensor electrical resistance probes 48 and 50, respectively, of an ink level sensing mechanism 52 in accordance with an embodiment of the present invention.

The ink level sensing mechanism 52 determines an amount (i.e., volume) of ink 18 with the ink cartridge 12. In particular, the ink level sensing mechanism 52, which will be described more fully below, precisely senses a low ink level condition of the ink reservoir 16 of the ink cartridge 12.

As seen in FIGS. 1–7, the first and second resistance probes 48 and 50 are mounted on a bottom wall 54 of the housing 14 of the ink cartridge 12. This bottom wall 54 is orthogonal to a front side wall 56 of the housing 14 that includes the nozzle plate 26 of the printhead 24. The fluid outlet 22 is also located in this side wall 56. The first and second resistance probes 48, 50 are positioned on the housing 14 below the fluid outlet 22. As seen best in FIGS.

1 and 3–7, to mount the first and second resistance probes 48, 50 to the bottom wall 54 of the housing 14, the bottom wall 54 includes first and second sensor ports 58 and 60, respectfully, that are in fluid communication with the ink reservoir 16. Each of the first and second sensor ports 58, 60 is defined by a cylindrical aperture that extends through the bottom wall 54 from an exterior surface 62 to an interior surface 64 of the housing 14. The first resistance probe 48 is positioned in the first sensor port 58, while the second resistance probe 50 is positioned in the second sensor port 60. The first and second resistance probes 48, 50 are force fit into the first and second sensor ports 58, 60, and thereby are retained in the sensor ports 58, 60 by way of a tight interference fit that also prevents fluid leakage from the ink reservoir 16.

Figure 2A:
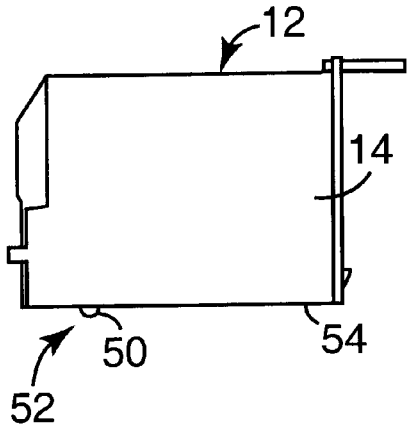
FIG. 2A is a side view of the replaceable ink cartridge with ink level sensing mechanism in accordance with an embodiment of the present invention.
Figure 2B:
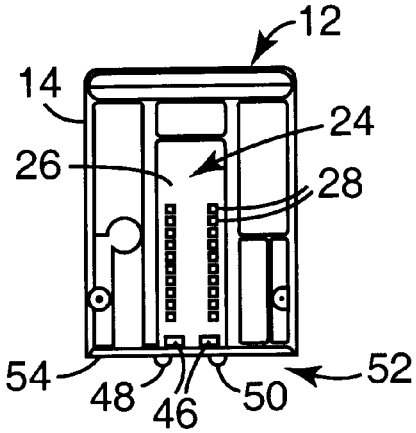
FIG. 2B is a front end view of the replaceable ink cartridge with ink level sensing mechanism of FIG. 2A illustrating details of a nozzle array for ejecting ink drops onto print media.
Figure 2C:
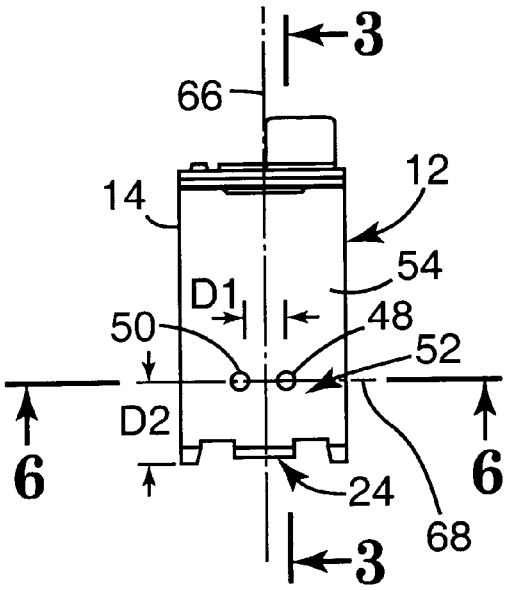
FIG. 2C is a bottom view of the replaceable ink cartridge with ink level sensing mechanism of FIG. 2A illustrating details of the ink level sensing mechanism.

As seen best in FIGS. 2A–2C, the sensor ports 58, 60 and thereby the resistance probes 48, 50 are symmetrically located off of a centerline 66 of the housing 14 of the ink cartridge 12. Moreover, the sensor ports 58, 60 and thereby the resistance probes 48, 50 form a line 68 that is parallel with the front side wall 56 of the housing 14. As such the resistance probes 48, 50 (and sensor ports 58, 60) are equally spaced from the nozzle plate 26 of the printhead 24 and the fluid outlet 22.

In one preferred embodiment, the first and second resistance probes 48 and 50 are separated by a distance D1 of 0.125" (see FIG. 2C) and are spaced from the front side wall 56 by a distance D2 of 0.60" (see FIG. 2C).

As seen best in FIGS. 3–7, the sensor ports 58, 60 allow mounting of the first and second resistance probes 48, 50 to the housing 14 such that the resistance probes 48, 50 are in fluid communication with the supply of ink 18, but free from any contact with the capillary ink storage member 20. A change in electrical resistance imparted to and measured across the resistance probes 48, 50 by the printer control electronics 42 indicates the amount (i.e., volume) of ink 18 in the ink reservoir 16. In particular, the electrical resistance measured across the first and second resistance probes 48, 50 by the printer control electronics 42 indicates a low ink condition in the ink reservoir 16. The first and second resistance probes 48, 50 protrude from the exterior surface 62 of the bottom wall 54 of the housing 14 such that the resistance probes 48, 50 define a pair of electrical contacts for engaging the corresponding ink level sensor electrical contacts 36 of the receiving station 34 when the ink cartridge 12 is inserted into the receiving station of the printing system 10.

In one preferred embodiment each of the first and second resistance probes 48, 50 is a sphere made of metal, such as steel. Each sphere has a diameter of 0.060" and protrudes 0.0015" from the exterior surface 62 of the bottom wall 54.

Figure 3:
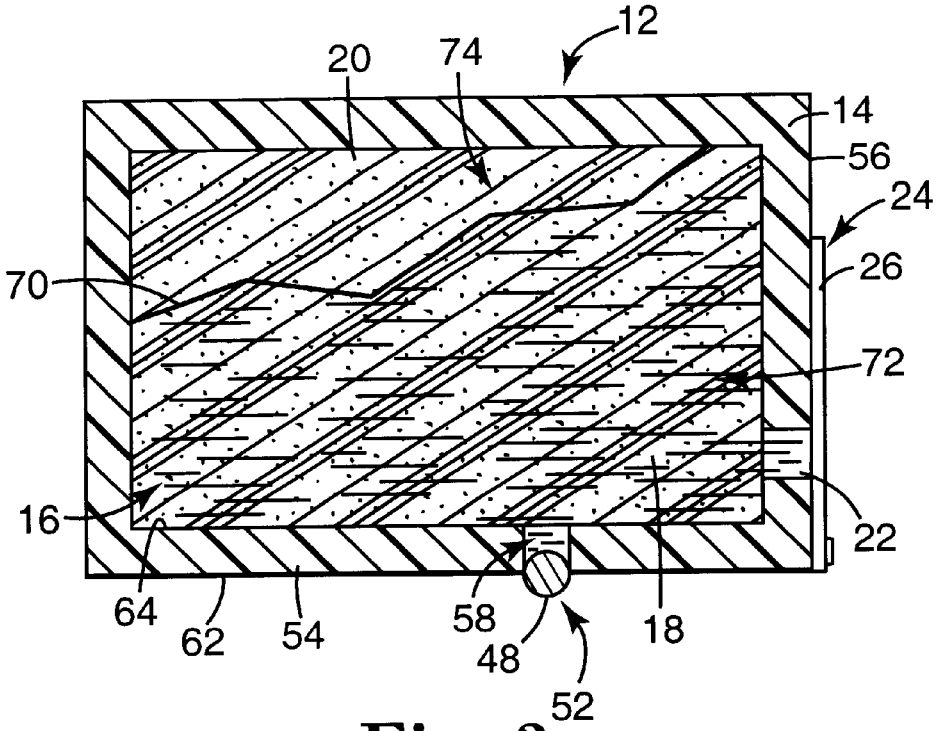
FIG. 3 is a sectional view taken along line 3—3 in FIG. 2C depicting the replaceable ink cartridge and the ink level sensing mechanism of FIG. 1 showing the ink cartridge partially depleted of ink.
Figure 4:
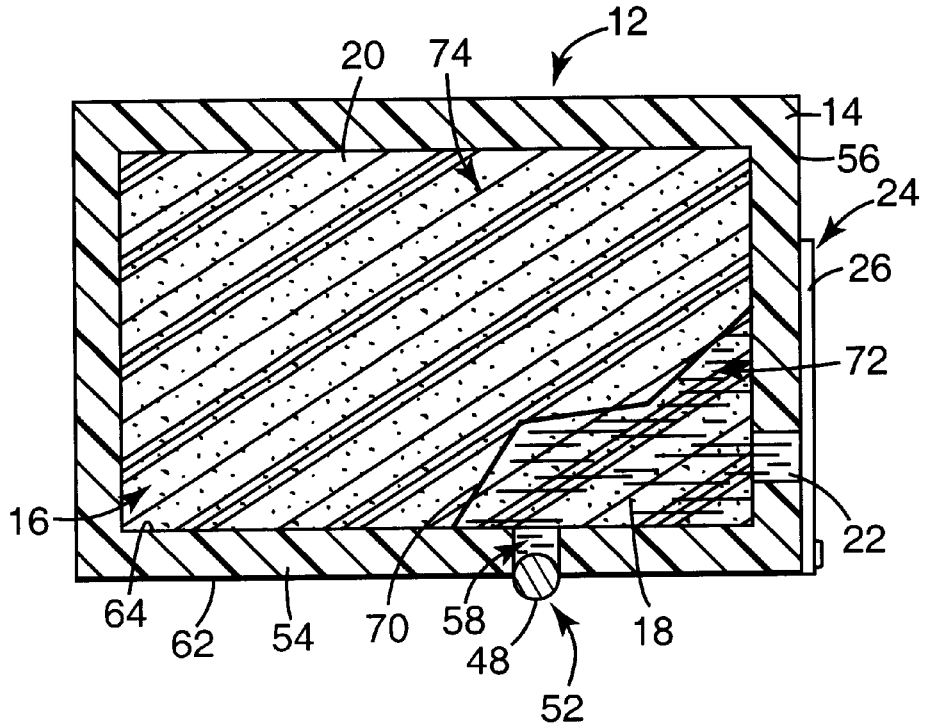
FIG. 4 is a sectional view similar to FIG. 3 showing the ink cartridge further depleted of ink.
Figure 5:
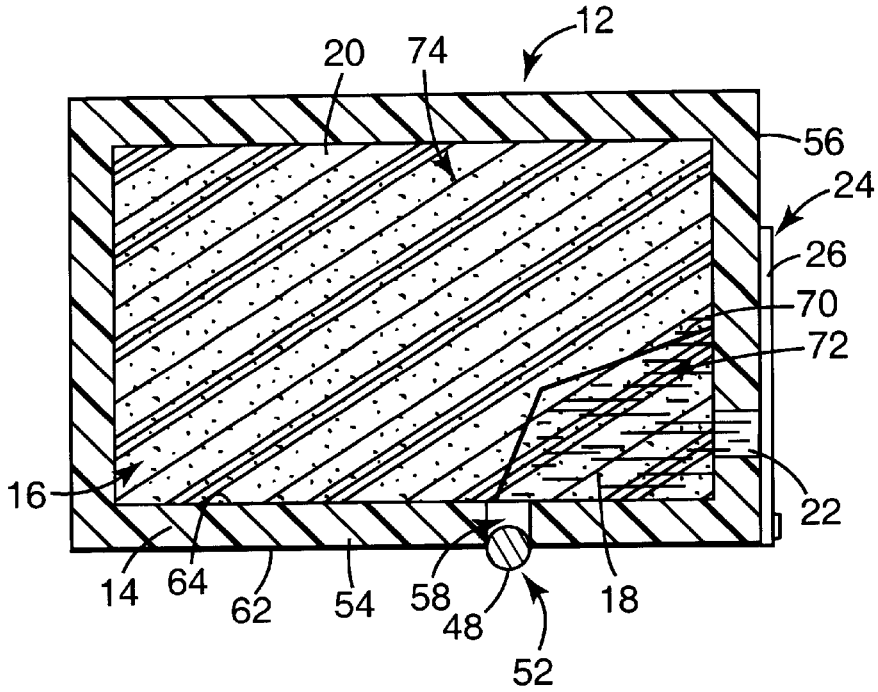
FIG. 5 is a sectional view similar to FIGS. 3 and 4 illustrating the ink cartridge even further depleted of ink and the binary action of the ink level sensing mechanism in accordance with an embodiment of the present invention.
Figure 6:
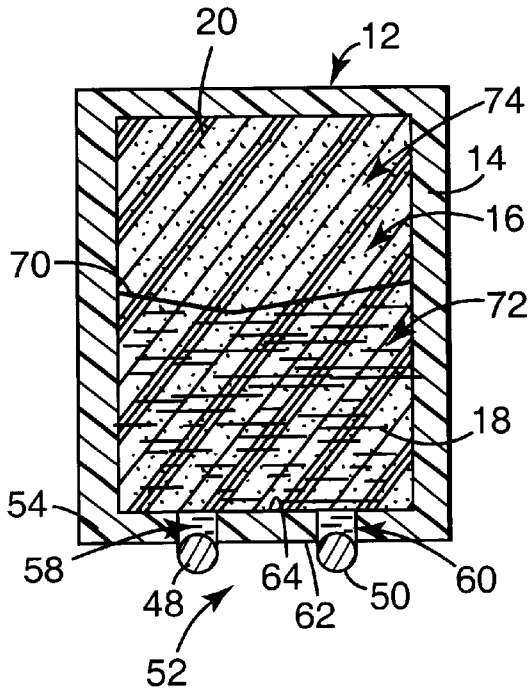
FIG. 6 is a sectional view taken along line 6—6 in FIG. 2C and corresponding to the level of depletion of ink illustrated in FIG. 4.
Figure 7:
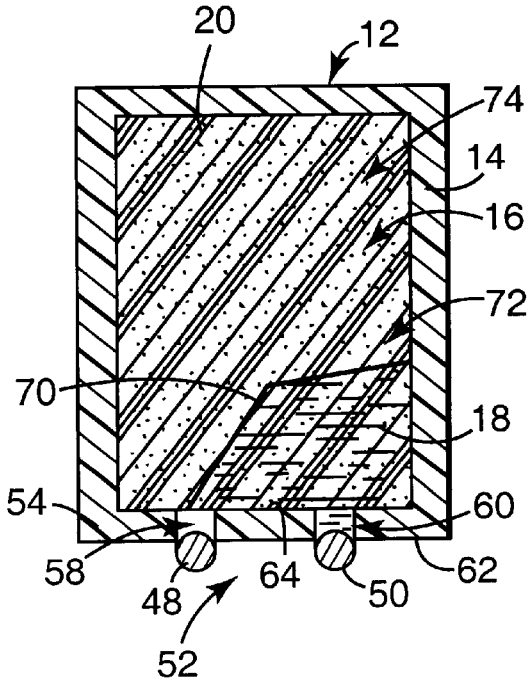
FIG. 7 is a sectional view similar to FIG. 6 and corresponding to the level of ink depletion and the binary action of the ink level sensing mechanism illustrated in FIG. 5.

Operation of the ink level sensing mechanism 52 is based on the principle of capillary pressure provided by pores in the capillary ink storage member 20 and fluid dynamics. FIGS. 3, 4 and 6 depict the ink level sensing mechanism 52 in an "ON" state, while FIGS. 5 and 7 depict the ink level sensing mechanism 52 in an "OFF" state. In the "ON" state both of the sensor ports 58, 60 are full of ink 18. In the "OFF" state at least one and possible both of the sensor ports 58, 60 is drained (i.e., free) of ink 18 which indicates a low level ink condition of the ink reservoir 16 of the ink cartridge 12. In the "ON" state the electrical resistance measured across the first and second resistance probes 48, 50 is low since the sensor ports 58, 60 are full of ink 18. In the "OFF" state the electrical resistance measured across the first and second resistance probes 48, 50 is high since at least one of the sensor ports 58, 60 and possibly both sensor ports 58, 60 is free of ink 18.

FIGS. 3, 4 and 6 depict the ink cartridge 12 of the present invention having an ink level, otherwise known as an ink front 70. The ink front 70 is a dividing line between an ink filled portion 72 of the capillary ink storage member 20 and an ink empty portion 74 of the capillary ink storage member 20. In operation of the ink level sensing mechanism 52, as long as the ink front 70 is not coincident with at least one of the sensor ports 58, 60 (FIGS. 3, 4 and 6), the sensor ports 58, 60 of the ink level sensing mechanism 52 are full of ink and in static equilibrium. In other words, the ink level sensing mechanism 52 is in the "ON" state. However, as seen in FIGS. 5 and 7, as soon as the ink front 70 reaches the first sensor port 58 or the second sensor port 60 or both of the first and second sensor ports at the same time, the ink is sucked from the respective sensor port or ports 58, 60 of the ink level sensing mechanism 52 and into the capillary ink storage member 20 due to an imbalance in the capillary pressures at the ink/air interfaces between the capillary member 20 and the respective sensor port or ports 58, 60. The resulting sudden (i.e., instantaneous) depletion of ink in the sensor port or ports 58, 60 of the ink level sensing mechanism 52 provides a binary fluidic indicator. In other words, the electrical resistance measured across the first and second resistance probes 48, 50 immediately increases and the ink level sensing mechanism 52 immediately goes from the "ON" state to the "OFF" state indicating a low level ink condition for the ink cartridge 12. Hence, the use of the term "binary" to describe the ink level sensing mechanism 52. This increase in electrical resistance measured across the first and second resistance probes 48, 50 (i.e., the binary fluidic indicator) is immediately detected by the printer control electronics 42, whereupon the printer control electronics 42 can notify a user of the low ink condition of the ink reservoir 16 and/or through calculations and estimation, an out of ink condition of the ink reservoir 16 of the ink cartridge 12.

Figure 8:
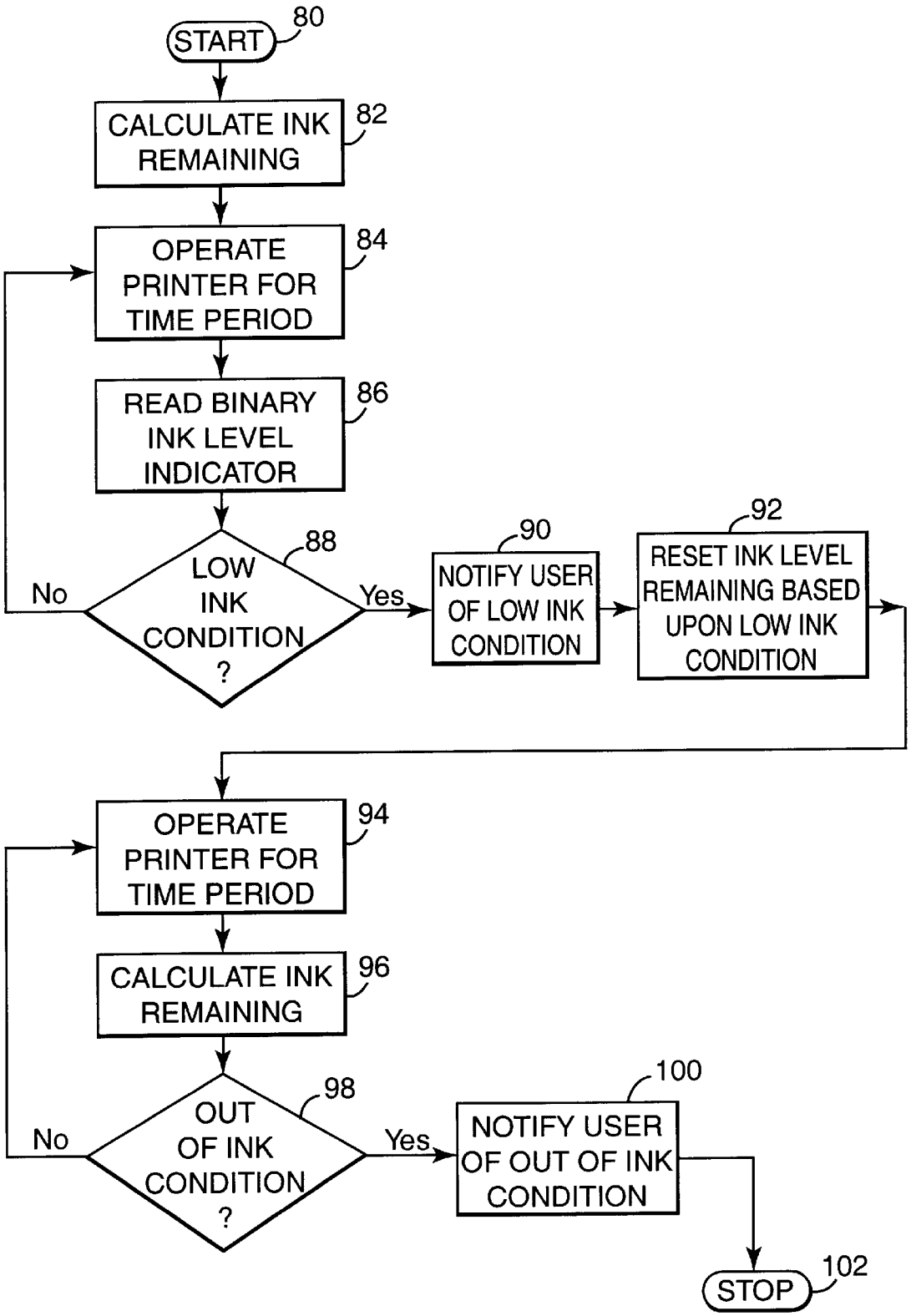
FIG. 8 is a flow chart depicting the process involving the ink level sensor of FIGS. 1–7 for determining a low ink and out of ink conditions for the ink cartridge in accordance with an embodiment of the present invention.

Turning to FIG. 8, the logic diagram shown depicts one manner a printing system 10 can determine the remaining ink level (i.e., remaining ink volume) within the replaceable ink cartridge 12 using the ink level sensing mechanism 52 to ultimately notify a user of an out of ink condition. Upon power up or when a print job starts (step 80), the printing system 10 calculates the ink level remaining in the ink reservoir 16 of the ink cartridge 12 (step 82). This calculation of ink remaining is estimated by the printing system 10 in a known manner using drop volume coefficients and drop counting at the printhead 24 by way of the printer control electronics 42. In particular, the printing system 10 nominally knows how much ink is in the ink cartridge 12 at a first printing. During printing, the printing system 10 counts the drops that are fired by the printhead 24, and calculates the estimated amount of ink used from that drop count and knowledge of the amount of ink per drop. This estimate of ink used is then subtracted from the starting estimate of ink remaining in the cartridge 12, and the resulting value is stored as the amount of ink remaining in the cartridge 12 (step 82).

Once the ink level remaining within the cartridge 12 is known (assuming the printing system 10 has determined that the ink reservoir 16 of the ink cartridge 12 is not empty) the printing system 10 can operate. The printing system 10 operates by carrying out print jobs. At the end of each print job the ink level remaining in the ink cartridge 12 is recalculated such that the cartridge 12 constantly maintains a running estimate of the ink remaining within the reservoir 16 (step 84). This estimate of ink remaining within the ink cartridge 12 is not precise due variations in fill level within the container and variations in drop weight and drop count.

During operation of the printing system 10, the electrical resistance across the first and second resistance probes 48, 50 is constantly measured by the printer control electronics 42 (step 86). In step 88, if there is ink 18 in both of the sensor ports 58, 60 indicating an "ON" state of the ink level sensing mechanism 52 (i.e., if at least one or both of the ports 58, 60 is not drained of ink so as to produce the "OFF" state indicator) which indicates that there is not a low ink condition within the ink reservoir 16, the printing system 10 can continue to operate and recycle through steps 84, 86 and 88. However, if at step 88 at least one or both of the sensor ports 58, 60 is drained of ink 18 so as to produce the "OFF" state indicator of the ink level sensing mechanism 52, the printer control electronics 42 knows that the capillary member 20 is approximately 70% depleted of ink 18 and that the ink front 70 is coincident with at least one of the ports 58, 60. Upon this "OFF" state indication, the printing system 10 knows how much ink remains in the capillary member 20, since these values are programmed into the printing system 10 at manufacture. In one embodiment, at this point the printing system 10 can notify a user of a low ink condition (step 90) of the ink cartridge 12 so that the user has adequate time to purchase a replacement ink container before the current ink cartridge 12 runs out of ink.

With this ink level (i.e., approximately 30% of ink remaining), the printing system 10 can re-set or re-calibrate the ink level remaining estimate of the ink cartridge 12 which has been accounting all along (step 92). In other words, the estimate is replaced at that point with a known value. At this point, the printing system 10 can continue to operate and perform print jobs (step 94). At the end of each print job, the ink level remaining in the ink cartridge 12 is recalculated, as described previously, by estimating the amount of ink used from the drop count and knowledge of the amount of ink per drop, such that the cartridge 12 constantly maintains a running estimate of the ink remaining within the reservoir 16 (step 96). In step 98, if based upon these calculations and estimations the printer control electronics 42 determines that the ink cartridge 12 still has ink remaining (i.e., that there is not an out of ink condition), the printing system 10 can continue to operate and recycle through steps 94, 96 and 98. However, if at step 98 the printer control electronics 98 determines through calculation and estimations that the ink cartridge 12 has no ink remaining (i.e., that there is an out of ink condition), the printing system 10 by way of the printer control electronics 42 notifies a user of the out of ink condition (step 100) and ceases operation (step 102) until the empty ink cartridge 12 is replaced with an ink cartridge containing a sufficient amount of ink for printing.

While a low ink condition within the ink cartridge 12 has been described as approximately 30% of ink remaining in the ink reservoir 16, it is to be understood that other values can be used to indicate a low ink condition. In practice, forming the ports 58, 60 (in the bottom wall 54) closer to the fluid outlet 22 results in a low ink condition indication of less than 30% of ink remaining, while forming the ports 58, 60 further from the fluid outlet 22 results in a low ink condition indication of greater than 30% of ink remaining in the ink reservoir 16.

This ink cartridge 12 employing an electrical resistance ink level sensing mechanism 52 allows a printing system 10 to reliably and accurately determine the ink level within the ink reservoir 16 of the ink cartridge 12. In particular, by providing the ink reservoir 16 with first and second sensor port 58, 60 mounted electrical resistance probes 48, 50 allows a low ink condition of the ink reservoir 16 to be immediately determined by a change in electrical resistance measured across the probes 48, 50 as a result of at least one of the sensor ports 58, 60 becoming free of ink 18. Moreover, the resistance probes 48, 50 perform both an ink level sensing function and an electrical connection function with the printing system 10, resulting in a reduction in parts and complexity. In addition, since the resistance probes 48, 50 are metal spheres that only protrude a limited distance from the exterior surface 62 of the ink cartridge housing 14, they are less susceptible to being soiled or damaged during routine handling of the replaceable ink cartridge 12 by a user. Lastly, since the metal spheres that define the resistance probes 48, 50 are interference fit (i.e., force fit) into the sensor ports 58, 60, the ink cartridge 12 employing the ink level sensing mechanism 52 of the present invention is relatively easy and inexpensive to manufacture.

Although the present invention has been described with reference to preferred embodiments, workers skilled in the art will recognize that changes may be made in form and detail without departing from the spirit and scope of the invention.

What is claimed is:

1. A replaceable ink container for providing ink to a printhead of a printing system, the ink container comprising:
- an ink reservoir for containing a supply of ink, the ink reservoir including a capillary ink storage member; and
- an ink level sensor for determining an amount of ink in the ink reservoir, the ink level sensor including:
  - first and second resistance probes in fluid communication with the supply of ink and free from contact with the capillary ink storage member, wherein a change in electrical resistance measured across the first and second probes indicates the amount of ink in the ink reservoir;
  - a first sensor port in fluid communication with the ink reservoir, wherein the first resistance probe is positioned in the first sensor port; and
  - a second sensor port in fluid communication with the ink reservoir, wherein the second resistance probe is positioned in the second sensor port.

2. The replaceable ink container of claim 1 wherein each of the first and second sensor ports extends through the ink reservoir from an exterior surface to an interior surface.

3. The replaceable ink container of claim 1 wherein the ink reservoir includes a fluid outlet and wherein the first and second sensor ports are equally spaced from the fluid outlet.

4. The replaceable ink container of claim 3 wherein the fluid outlet is a plurality of ink ejection nozzles of the printhead.

5. A replaceable ink cartridge for depositing ink onto a print medium, the replaceable ink cartridge comprising:
- an ink reservoir for containing a supply of ink;
- an ink ejection device in fluid communication with the ink reservoir, the ink ejection device having a plurality of ejection nozzles for depositing ink onto the print medium; and
- an ink level sensor for determining an amount of ink in the ink reservoir, the ink level sensor including:
  - first and second resistance probes equally spaced from the ink ejection device and in fluid communication with the supply of ink, wherein a change in electrical resistance measured across the first and second probes indicates the amount of ink in the ink reservoir;

and wherein each of the first and second resistance probes protrudes from an exterior surface of the ink reservoir to define a pair of electrical contacts for engaging a corresponding pair of electrical contacts when the replaceable ink cartridge is inserted into a printing system.

6. The replaceable ink cartridge of claim 5 wherein the ink reservoir includes a first wall and a second wall orthogonal to the first wall, and wherein the ink ejection device is positioned on the first wall and the first and second resistance probes are positioned on the second wall.

7. The replaceable ink cartridge of claim 6 wherein the first wall is a side wall of the ink reservoir and the second wall is a bottom wall of the ink reservoir.

8. A replaceable ink container for providing ink to a printhead for an inkjet printing system, the ink jet printing system having a receiving station for receiving the replaceable ink container, the receiving station including a plurality of electrical contacts, the ink container comprising:

an ink reservoir having a supply of ink and a fluid outlet for providing ink to the printhead, the ink reservoir including a capillary ink storage member; and an ink level sensor for determining a volume of ink in the ink reservoir, the ink level sensor including:

first and second resistance probes mounted to the ink reservoir and in fluid communication with the supply of ink, wherein the first and second resistance probes are positioned below the fluid outlet, and wherein a change in electrical resistance measured across the first and second probes indicates the volume of ink in the ink reservoir wherein the first and second resistance probes are first and second metallic spheres, respectfully; and a first cylindrical shaped sensor port in fluid communication with the ink reservoir, wherein the sphere is positioned in the first sensor port; and a second cylindrical shaped sensor port in fluid communication with the ink reservoir, wherein the second sphere is positioned in the second sensor port.

9. The replaceable ink container of claim 8 wherein the first of the first and second spheres are secured within the first and second sensor ports by an interference fit.

10. A replaceable ink container for providing ink to a printhead of a printing system, the ink container comprising:

an ink reservoir including a capillary ink storage member; and an ink level sensor for determining an amount of ink in the ink reservoir, the ink level sensor including:

a first resistance probe in fluid communication with the ink reservoir; a sensor port in fluid communication with the ink reservoir; and a second resistance probe coupled to the sensor port and free of any contact with the capillary ink storage member, wherein there is a difference in electrical resistance across the first and second probes when ink is in the port and when the port is free of ink thereby indicating the amount of ink in the ink reservoir;

a further sensor port in fluid communication with the ink reservoir, and wherein the first resistance probe is coupled to the further sensor port and is free of any contact with the capillary ink storage member, and wherein there is a difference in electrical resistance across the first and second probes when ink is in the sensor port and the further sensor port and when at least one of the sensor port and the further sensor port is free of ink, thereby indicating the amount of ink in the ink reservoir.

11. The replaceable ink container of claim 10 wherein when ink is in the sensor port and the further sensor port the electrical resistance across the first and second probes is low, and wherein when at least one of the sensor port and the further sensor port is free of ink the electrical resistance across the first and second ports is high.

12. A method for determining ink level information for a replaceable ink container, the replaceable ink container providing ink to a printhead of an inkjet printing system, the method comprising:

providing a replaceable ink container defining an ink reservoir containing a supply of ink;

providing the ink reservoir with an ink level sensor including first and second electrical resistance probes in fluid communication with the supply of ink;

calculating the ink level remaining in the ink container based upon drop volume coefficients and drop counting at the printhead;

monitoring the electrical resistance measured across the first and second electrical resistance probes; and notifying a user of a low ink condition when the electrical resistance measured across the first and second electrical resistance probes changes.

13. The method for determining ink level information of claim 12 wherein the change in the electrical resistance measured across the first and second resistance probes is an increase in electrical resistance.

14. The method for determining ink level information of claim 12 wherein after notifying a user of a low ink condition when the electrical resistance measured across the first and second electrical resistance probes changes, the method includes:

using the low ink condition ink level and calculating the ink level remaining in the ink container to an out of ink condition based upon drop volume coefficients and drop counting at the printhead.

* * * * *